US008595953B2

(12) United States Patent
Lee et al.

(10) Patent No.: US 8,595,953 B2
(45) Date of Patent: Dec. 3, 2013

(54) DIAGNOSING METHOD FOR CLOTHES TREATING APPARATUS AND CLOTHES TREATING APPARATUS WITH REFRIGERANT LEAKAGE DETECTING MEANS

(75) Inventors: Hyuksoo Lee, Seoul (KR); Sungho Song, Seoul (KR); Sungmin Ye, Seoul (KR); Seonghwan Kim, Seoul (KR); Byeongjo Ryoo, Seoul (KR)

(73) Assignee: LG Electronics Inc., Seoul (KR)

( * ) Notice: Subject to any disclaimer, the term of this patent is extended or adjusted under 35 U.S.C. 154(b) by 247 days.

(21) Appl. No.: 13/247,346

(22) Filed: Sep. 28, 2011

(65) Prior Publication Data

US 2012/0079736 A1 Apr. 5, 2012

(30) Foreign Application Priority Data

Sep. 30, 2010 (KR) ..... 10-2010-0095489
Sep. 30, 2010 (KR) ..... 10-2010-0095491

(51) Int. Cl.
*F26B 5/06* (2006.01)

(52) U.S. Cl.
USPC ..... 34/413; 34/524; 34/565; 34/610; 60/39.15; 62/617; 68/5 C; 8/137

(58) Field of Classification Search
USPC ..... 34/381, 413, 487, 497, 524, 565, 595, 34/602, 606, 610; 62/617, 618, 620; 8/137, 158; 68/5 C, 18, 19, 20; 60/39.15, 39.19
See application file for complete search history.

(56) References Cited

U.S. PATENT DOCUMENTS

| | | | | | |
|---|---|---|---|---|---|
| 2,495,535 | A * | 1/1950 | Morrison | 34/76 |
| 3,027,653 | A * | 4/1962 | Long et al. | 34/86 |
| 3,290,793 | A * | 12/1966 | Jacobs et al. | 34/76 |
| 4,621,438 | A * | 11/1986 | Lanciaux | 34/77 |
| 5,343,632 | A * | 9/1994 | Dinh | 34/507 |
| 5,343,715 | A * | 9/1994 | Lang | 62/381 |
| 7,603,878 | B2 * | 10/2009 | Fyvie | 68/18 R |
| 7,665,225 | B2 * | 2/2010 | Goldberg et al. | 34/73 |

(Continued)

FOREIGN PATENT DOCUMENTS

| | | | |
|---|---|---|---|
| DE | 4212700 | A1 * | 10/1993 |
| DE | 4330456 | C1 * | 3/1995 |
| EP | 999302 | A1 * | 5/2000 |
| EP | 1983095 | A2 * | 10/2008 |

(Continued)

*Primary Examiner* — Steve M Gravini
(74) *Attorney, Agent, or Firm* — Birch, Stewart, Kolasch & Birch, LLP

(57) ABSTRACT

A clothes treating apparatus includes a drum configured to accommodate therein an object to be dried, an air suction device configured to form a flow path of air introduced into the drum, an air exhaustion device configured to form a flow path of air exhausted from the drum, a condenser disposed to heat air sucked into the drum through the air suction device, an evaporator disposed to cool air exhausted from the drum the air exhaustion device, and a compressor and an expander configured to constitute a heat pump together with the condenser and the evaporator. The method includes a temperature detection step of detecting a temperature change of air passing through the condenser or the air suction device, and a determination step of determining that refrigerant leakage has occurred when a temperature decrease amount measured in the temperature detection step is more than a predetermined level.

18 Claims, 4 Drawing Sheets

(56) References Cited

U.S. PATENT DOCUMENTS

| | | | | |
|---|---|---|---|---|
| 8,353,114 | B2 * | 1/2013 | Beers et al. | 34/343 |
| 2006/0179676 | A1 * | 8/2006 | Goldberg et al. | 34/77 |
| 2010/0212367 | A1 * | 8/2010 | Kim et al. | 68/19 |
| 2010/0212368 | A1 * | 8/2010 | Kim et al. | 68/19 |
| 2010/0281915 | A1 * | 11/2010 | Roberts et al. | 62/612 |
| 2011/0277334 | A1 * | 11/2011 | Lee et al. | 34/73 |
| 2012/0058022 | A1 * | 3/2012 | Revankar et al. | 422/187 |
| 2012/0079736 | A1 * | 4/2012 | Lee et al. | 34/476 |
| 2012/0102781 | A1 * | 5/2012 | Beers et al. | 34/499 |

FOREIGN PATENT DOCUMENTS

| | | | | |
|---|---|---|---|---|
| JP | 2007-82588 | A | | 4/2007 |
| JP | 2007143631 | A | * | 6/2007 |
| JP | 2007-244567 | A | | 9/2007 |
| JP | 2007-301130 | A | | 11/2007 |
| JP | 2007301178 | A | * | 11/2007 |
| JP | 2013017639 | A | * | 1/2013 |
| KR | 1996-0024190 | A | | 7/1996 |

* cited by examiner

DIAGNOSING METHOD FOR CLOTHES TREATING APPARATUS AND CLOTHES TREATING APPARATUS WITH REFRIGERANT LEAKAGE DETECTING MEANS

TECHNICAL FIELD

The present invention relates to a diagnosing method for a clothes treating apparatus and a clothes treating apparatus with a refrigerant leakage detecting means, and more particularly, to a method for determining whether refrigerant leakage has occurred or not in a clothes treating apparatus having a heat pump system, and a clothes treating apparatus having a refrigerant leakage detecting means.

BACKGROUND ART

Generally, a clothes treating apparatus having a drying function, such as a washing machine or a clothes dryer, serves to dry laundry having been completely washed and dehydrated, by introducing the laundry into a drum, by supplying hot blast into the drum, and then by evaporating moisture from the laundry.

Hereinafter, the clothes treating apparatus will be explained with taking a clothes dryer as an example. The clothes dryer includes a drum rotatably installed in a body and having laundry introduced thereinto, a driving motor configured to drive the drum, a blowing fan configured to blow air into the drum, and a heating means configured to heat air introduced into the drum. The heating means may use high-temperature electric resistance heat generated from an electric resistance, or combustion heat generated from gas combustion.

Air exhausted from the drum is in a state of a middle temperature and a high humidity due to moisture of the laundry inside the drum. According to a method for processing the air of a middle temperature and a high humidity, the clothes dryer may be classified into a condensation type (circulation type) and an exhaustion type. The condensation type clothes dryer is configured to condense moisture included in the air of a middle temperature and a high humidity, by circulating and cooling the air into a temperature less than a dew point through a condenser, without exhausting the air to the outside. And, the exhaustion type clothes dryer is configured to directly exhaust the middle temperature-high humidity air having passed through the drum to the outside.

In the case of the condensation type clothes dryer, the air has to be cooled into a temperature less than a dew point so as to condense the air exhausted from the drum. And, the air has to be heated by the heating means before being re-supplied into the drum. Here, the air may have the loss of its thermal energy while being cooled. In order to heat the air to a temperature high enough to perform a drying operation, required is an additional heater, etc.

In the case of the exhaustion type clothes dryer, it is also required to exhaust the air of a middle temperature and a high humidity to the outside, to introduce external air of a high temperature, and to heat the external air into a desired temperature by the heating means. Especially, high-temperature air exhausted to the outside includes thermal energy transmitted by the heating means. However, the thermal energy is exhausted to the outside, resulting in lowering of the thermal efficiency.

In order to overcome these problems, being proposed is a clothes treating apparatus capable of enhancing the energy efficiency by collecting energy required to generate hot blast, and energy exhausted to the outside without being used. As one example of the clothes treating apparatus, a clothes treating apparatus having a heat pump system is being recently introduced. The heat pump system is provided with two heat exchangers, a compressor and an expander, and enhances the energy efficiency by collecting energy of exhausted hot blast and by re-using the energy to heat air supplied into the drum.

More concretely, the heat pump system is provided with an evaporator at an exhaustion side, and with a condenser at a suction side near the drum. And, the heat pump system transmits thermal energy to a refrigerant through the evaporator, and transmits thermal energy of the refrigerant to air introduced into the drum through the condenser, thereby generating hot blast with using abandoned energy. Here, the heat pump system may further include a heater configured to re-heat air heated while passing through the condenser.

The clothes dryer having the heat pump system may have inferiority during a manufacturing process, or damages may occur on the condenser or connection parts between the condenser and refrigerant pipes due to impacts while the clothes dryer is operated. In the case that the condenser or the refrigerant pipes are damaged, a refrigerant flowing therein leaks to cause an unstable driving of the heat pump system. As a result, the apparatus may have a shortened lifespan, and the amount of energy consumption may be increased.

In the conventional art, since the heat pump system is mounted at a position where a user has a difficulty in checking with his or her naked eyes, whether refrigerant leakage has occurred or not is not easily checked periodically. Furthermore, it is impossible to real-time check refrigerant leakage despite the fact that a reaction has to be taken against even a small amount of refrigerant leakage.

DISCLOSURE OF THE INVENTION

Therefore, an object of the present invention is to provide a clothes treating apparatus having a heat pump system, the apparatus capable of rapidly and easily detecting whether refrigerant leakage has occurred or not.

Another object of the present invention is to provide a clothes treating apparatus having a refrigerant leakage detecting means for rapidly and easily detecting whether refrigerant leakage has occurred or not.

To achieve these and other advantages and in accordance with the purpose of the present invention, as embodied and broadly described herein, there is provided a method for diagnosing a clothes treating apparatus comprising a drum configured to accommodate therein an object to be dried; an air suction means configured to form a flow path of air introduced into the drum; an air exhaustion means configured to form a flow path of air exhausted from the drum; a condenser disposed to heat air sucked into the drum through the air suction means; an evaporator disposed to cool air exhausted from the drum through the air exhaustion means; and a compressor and an expander configured to constitute a heat pump together with the condenser and the evaporator, the method comprising: a temperature detection step of detecting a temperature change of air passing through the condenser or the air suction means; and a determination step of determining that refrigerant leakage has occurred when a temperature decrease amount measured in the temperature detection step is more than a predetermined level.

In the present invention, the quantity of state of a refrigerant passing through the condenser may be real-time checked, and whether refrigerant leakage has occurred or not may be determined based on a change of the quantity of state. More concretely, in the occurrence of refrigerant leakage, an inner pressure of the condenser may be lowered than that in a case where no refrigerant leakage has occurred. By measuring the pressure lowering of the refrigerant, whether refrigerant leakage has occurred or not may be rapidly checked. In order to measure a pressure change inside the hermetic condenser, an expensive pressure sensor has to be used. In the present invention, temperature detections may be executed rather than using the expensive pressure sensor.

Once a refrigerant passing through the condenser has leaked, a pressure of the refrigerant may be lowered, and a temperature of the refrigerant inside the condenser may be decreased due to decrease of the refrigerant amount. Through this temperature decrease, whether pressure lowering of the refrigerant has occurred or not may be indirectly checked. Furthermore, once the refrigerant has leaked, the refrigerant may be evaporated with contacting air passing through the air suction means. This may lower a temperature of air inside the air suction means. Accordingly, it is possible to check whether refrigerant leakage has occurred or not, through a temperature change of air passing through the air suction means.

The method may further comprise a check step of checking an operation state of the compressor. The determination step may be executed only when the compressor is operated.

In the temperature detection step, a temperature may be measured from the surface of the condenser, and whether pressure lowering of the refrigerant has occurred or not may be indirectly checked based on the measured temperature. The temperature may be measured at an inner side of the air suction means, or may be measured at any position of a pipe on which the refrigerant flows.

When detecting a temperature from the surface of the condenser, a temperature measurement point may be a position outside the air suction flow path. That is, when measuring a temperature at an inner side of the air suction flow path along which air introduced into the air suction means flows, temperature measurements may be influenced by the flow of air. In order to minimize the influence, temperature measurements may be performed outside the air suction flow path, i.e., a position not influenced by the flow of.

According to another aspect of the present invention, there is provided a method for diagnosing a clothes treating apparatus comprising a drum configured to accommodate therein an object to be dried; an air suction means configured to form a flow path of air introduced into the drum; an air exhaustion means configured to form a flow path of air exhausted from the drum; a condenser disposed to heat air sucked into the drum through the air suction means; an evaporator disposed to cool air exhausted from the drum through the air exhaustion means; and a compressor and an expander configured to constitute a heat pump together with the condenser and the evaporator, the method comprising: a temperature detection step of detecting a temperature of a surface of the condenser; a pressure calculation step of calculating a pressure of a refrigerant inside the heat pump based on the detected temperature; and a determination step of determining that refrigerant leakage has occurred when a pressure lowering amount of the refrigerant is more than a predetermined level.

A refrigerant pressure may be calculated based on the detected temperature, and whether refrigerant leakage has occurred or not may be checked based on the calculated refrigerant pressure. Here, the pressure may be calculated from temperatures based on a correlation between a temperature and a pressure, the temperatures predetermined through experiments, etc.

To achieve these and other advantages and in accordance with the purpose of the present invention, as embodied and broadly described herein, there is also provided a clothes treating apparatus, comprising: a drum configured to accommodate therein an object to be dried; an air suction means configured to form a flow path of air introduced into the drum; an air exhaustion means configured to form a flow path of air exhausted from the drum; a condenser disposed to heat air sucked into the drum through the air suction means; an evaporator disposed to cool air exhausted from the drum through the air exhaustion means; a compressor and an expander configured to constitute a heat pump together with the condenser and the evaporator; a temperature detecting means configured to measure a temperature of the refrigerant; and a controller configured to determine whether refrigerant leakage has occurred or not based on a change of temperatures measured by the temperature detecting means.

Here, the temperature detecting means may be attached onto the surface of the condenser. For instance, the condenser may include a heat transfer portion contacting air moving after being introduced into the air suction means; and a non-contact portion not contacting the air. The temperature detecting means may be attached to the non-contact portion, and minimize influence by flow of the air.

In the present invention, whether refrigerant leakage has occurred or not may be rapidly and easily detected. This may enhance the reliability of the clothes treating apparatus, and improve the energy efficiency.

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, with reference to the attached drawings, will be explained a clothes treating apparatus having a refrigerant leakage detecting means, and a diagnosing method for the clothes treating apparatus.

Figure 1:
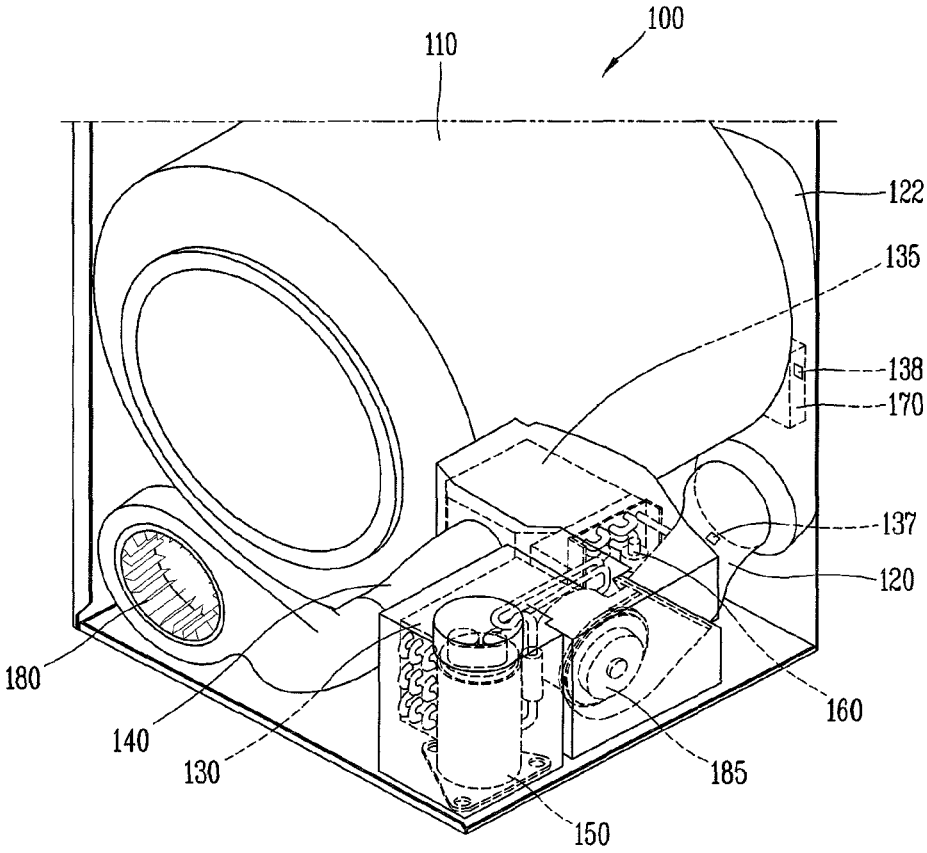
FIG. 1 is a perspective view schematically illustrating an inner structure of a clothes treating apparatus according to one embodiment of the present invention.
Figure 2:
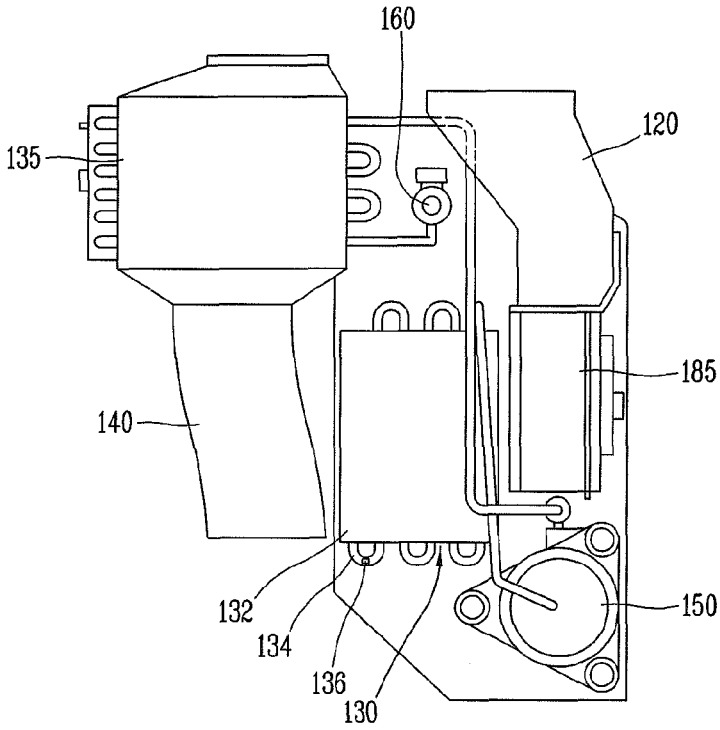
FIG. 2 is a planar view of the clothes treating apparatus of FIG. 1.

FIG. 1 is a perspective view schematically illustrating an inner structure of a clothes treating apparatus according to one embodiment of the present invention, and FIG. 2 is a planar view of the clothes treating apparatus of FIG. 1. Referring to FIGS. 1 and 2, FIG. 1 illustrates a clothes dryer. However, the present invention is not limited to the clothes dryer, but is applicable to any clothes treating apparatuses for drying laundry by supplying hot air into a drum, e.g., a washing machine having a drying function, etc. The clothes treating apparatus according to the present invention comprises a body 100 which forms the appearance of a clothes dryer, and a drum 110 rotatably installed in the body. The drum is rotatably supported by a supporter (not shown) at front and rear sides.

An air suction duct 120 which forms part of an air suction flow path toward inside of the drum 110 is installed at a bottom surface of the drum 110, and the end of the air suction duct 120 is connected to the end of a backduct 122. The backduct 122 is extending to an up-down direction of the body 100 between the air suction duct 120 and the drum 110, thereby introducing air having passed through the air suction duct 120 into the drum 110. Accordingly, formed is an air suction flow path through which air is introduced into the drum 110 by the air suction duct 120 and the backduct 122.

Air supplied through the air suction flow path is introduced into the body through an air suction port (not shown) formed on a rear surface or a bottom surface of the body, and then is transferred to the air suction duct 120. For this transfer of the air, an air suction fan 185 is installed at the end of the air suction duct 120. That is, air inside the body is introduced into the air suction duct 120 by rotation of the air suction fan 185. This may lower a pressure inside the body, thereby causing external air to be introduced into the body through the air suction port.

Rather than the air inside the body, air outside the body may be introduced.

A condenser 130 is installed at a front side of the air suction fan (upper stream side based on an air flow path). The condenser 130 constitutes a heat pump together with an evaporator 135, a compressor 150 and an expander 160 to be later explained. One refrigerant pipe 134 is arranged in a zigzag form, and radiation fins 132 are installed on the surface of the refrigerant pipe 134. Since the air suction fan 185 is positioned at a down stream side of the condenser 130, air sucked by the air suction fan 185 is heat-exchanged with a refrigerant with contacting the radiation fins 132 of the condenser 130. Then, the air is introduced into the drum in a state of an increased temperature.

A heater 170 is installed in the backduct 122 so as to additionally heat air having not been sufficiently heated by the condenser 103. The heater 170 may be installed at the air suction duct 120. This air heated while passing through the condenser 130 and the heater is introduced into the drum in the form of hot air, and then serves to dry an object to be dried and accommodated in the drum.

Then, the hot air is exhausted to an exhaust air duct 140 by an exhaust air fan 180 positioned below the drum 110, and then is heat-exchanged with a low-temperature refrigerant passing through inside of the evaporator 135 disposed at the end of the exhaust air duct 140. Then, the air is exhausted to outside of the body 100. Through these heat exchange processes, the air is exhausted to outside of the body 100 in a state of lowered temperature and humidity. Part of thermal energy of the exhaust air is transmitted to the refrigerant through the evaporator 135, and is re-transmitted to sucked air through the condenser. That is, thermal energy of the exhaust air is collected to be reused to generate hot air. This may reduce the amount of energy consumption.

The refrigerant circulates the compressor 150, the condenser 130, the expander 160 and the evaporator 135, sequentially. The refrigerant is in a high pressure state at an inlet of the condenser 130 since it has been compressed by the compressor 150.

In a case where a refrigerant pipe 134 of the condenser 130 has cracks or damages, the refrigerant leaks to outside through the cracks. This leaked refrigerant is introduced into the drum through the air suction duct 120 and the backduct 122. In the occurrence of refrigerant leakage, an inner pressure of the condenser 130 is lowered. Furthermore, the leaked refrigerant is evaporated from inside of the air suction duct, thereby temporarily lowering an inner temperature of the air suction duct.

Accordingly, required is a detection means for detecting a state change of a refrigerant so as to real-time check whether the refrigerant has leaked or not. The state may include an inner pressure of the condenser, a temperature of a refrigerant passing through inside of the condenser, and an air temperature inside the air suction duct. Here, it is the most precise to check refrigerant leakage by measuring an inner pressure of the condenser. However, in order to directly measure an inner pressure of the refrigerant pipe without causing leakage of a refrigerant of a high pressure, an expensive pressure sensor, etc. are required. This may increase the fabrication costs.

On the other hand, a temperature of a refrigerant passing through inside of the condenser may be indirectly analogized by measuring a temperature of the surface of the condenser. More concretely, in the occurrence of refrigerant leakage, a refrigerant temperature is changed. In this case, refrigerant leakage may be detected by merely detecting a change of a refrigerant temperature. Accordingly, a temperature of a refrigerant inside the condenser is not necessarily measured precisely. Whether refrigerant leakage has occurred or not may be indirectly checked by measuring a temperature on the surface of the condenser continuously or with a predetermined period, and by checking a degree of a temperature change in the occurrence of the temperature change.

A temperature detecting sensor 136 is provided on the surface of the refrigerant pipe 134 of the condenser 130. The temperature detecting sensor 136 may be provided at the radiation fins 132. However, the surface of the radiation fins 132 is in a contacted state with air passing through the air suction flow path. This may cause the surface of the radiation fins 132 to have a severe temperature change by a temperature and a volume of sucked air. This may influence on temperature measurement. Accordingly, the temperature detecting sensor 136 is provided at the end of the refrigerant pipe, i.e., outside the air suction flow path. This may minimize influence by air, and allow temperature measurement to be executed more precisely.

In some cases, a pressure of a refrigerant may be indirectly calculated by using a measured temperature of a refrigerant and an equation of state, or based on experimental temperatures measured by experiments in advance.

Alternatively, whether refrigerant leakage has occurred or not may be detected by a temperature change inside the air suction duct or the backduct. More concretely, temperature detecting sensors 137 and 138 are disposed on an inner wall of the air suction duct 120 or the backduct 122, thereby detecting a temperature change on the air suction flow path. In a case where a heater is provided on an inner wall of the air suction duct 120 or the backduct 122, the temperature detecting sensor 136 is preferably disposed between the heater 170 and the inner wall of the backduct or the air suction duct. This may allow a temperature change to be detected more precisely. More concretely, the periphery of the heater has a relatively higher temperature than other parts. In the event of refrigerant leakage, temperature lowering severely occurs at the periphery of the heater. This may cause the periphery of the heater to have a great temperature change than other parts, thereby enhancing precision in temperature measurement.

In the preferred embodiment, the temperature detecting sensor is installed at one of the condenser, the air suction duct and the backduct. However, the present invention is not limited to this. That is, a plurality of temperature detecting sensors may be installed at a plurality of positions, and temperatures measured at the respective positions are compared to one another. This may lower an error occurring when executing temperature measurement.

Figure 3:
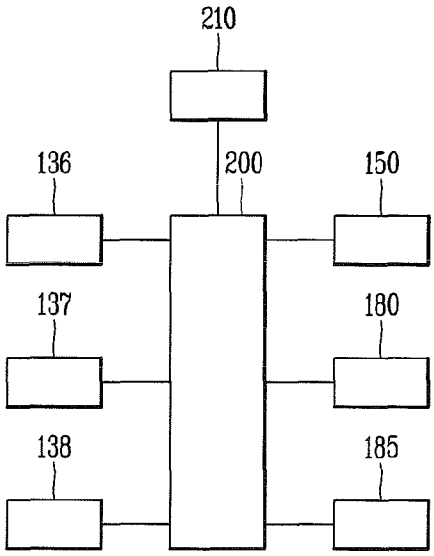
FIG. 3 is a block diagram schematically illustrating a configuration of a controller of the clothes treating apparatus of FIG. 1.

FIG. 3 is a block diagram schematically illustrating a configuration of the temperature detecting sensor and a controller. Referring to FIG. 3, a controller 200 provided on any position of the body 100 are electrically connected to the three temperature detecting sensors 136, 137 and 138, and receives a detection signal to determine whether refrigerant leakage has occurred or not. If it is determined that refrigerant leakage has occurred, the compressor 150 is stopped and the exhaust air fan 180 and the air suction fan 185 are operated, such that a leaked refrigerant is exhausted to outside without remaining in the drum or the air suction flow path.

Alternatively, whether refrigerant leakage has occurred or not may be informed to a user through a display apparatus 210 disposed on a manipulation panel (not shown) provided on a front surface of the body 100. In the event of refrigerant leakage, a temperature change is detected by all of the three temperature detecting sensors. The controller 200 is configured to determine whether refrigerant leakage has occurred or not, only in a case that a temperature change has been detected by at least two of the three temperature detecting sensors. However, the present invention is not limited to this. More concretely, whether refrigerant leakage has occurred or not may be determined in a case that a temperature change has been detected by one temperature detecting sensor.

If refrigerant leakage has been detected, the heat pump rather than the clothes dryer may be stopped, and hot air may be generated by using the heater thus to perform a drying operation. In this case, whether to operate the clothes dryer or not may be determined according to a degree of a leaked refrigerant.

Figure 4:
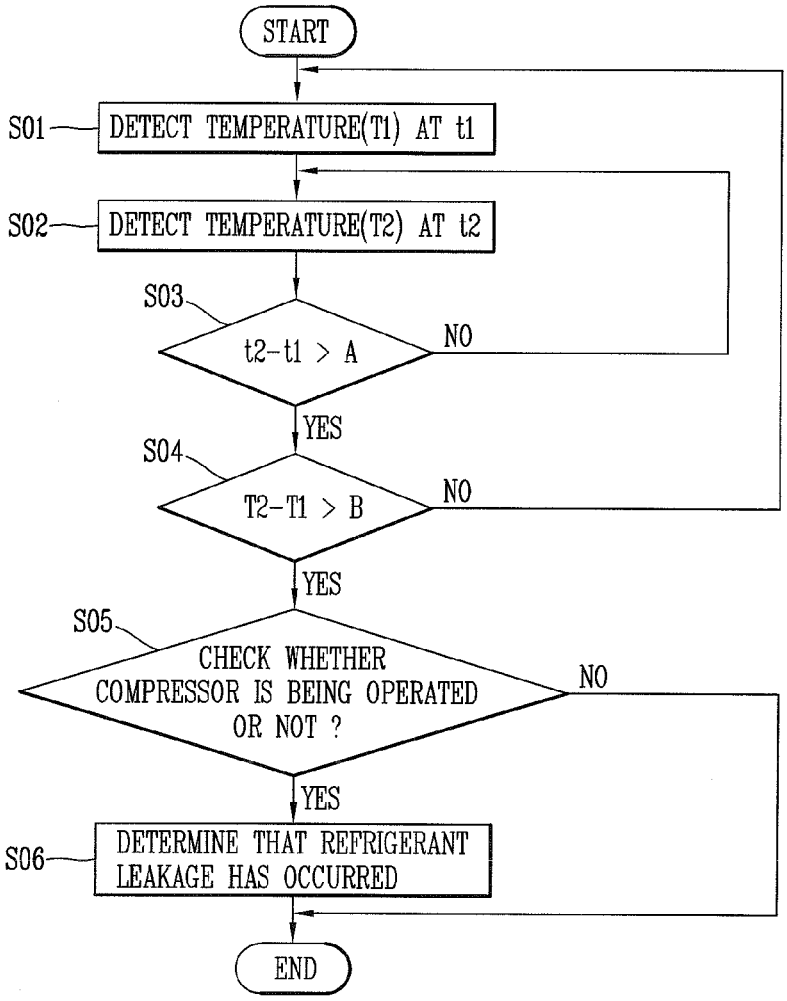
FIG. 4 is a flowchart illustrating processes of detecting whether a refrigerant has leaked or not.

Referring to FIG. 4, will be explained processes of determining, by the controller, whether refrigerant leakage has occurred or not. Firstly, a temperature is detected at any time point (t1) (S01). Here, the temperature is detected from one of the condenser, the air suction duct and the backduct. Then, a temperature is detected again at a time point (t2) after a predetermined time has lapsed (S02). Then, a time interval (t2−t1) is calculated, and the calculated time interval exceeds a predetermined value (A) or not (S03). If the time interval is less than the predetermined value (A), S02 is executed again. On the contrary, if the time interval is more than the predetermined value (A), S04 is executed.

In S04, it is determined whether a temperature difference (T2−T1) exceeds a predetermined value (B) or not. If the temperature difference is less than the predetermined value (B), it means that no refrigerant leakage has occurred. Accordingly, S01 is executed again. On the contrary, if the temperature difference is more than the predetermined value (B), it means a high possibility of refrigerant leakage. In a case that the compressor has been stopped, the temperature difference (T2−T1) may exceed the predetermined value (B) due to natural cooling even if no refrigerant leakage has occurred. Accordingly, whether the compressor is being operated or not is checked in S05. If the compressor is in a non-operating state, S01 is executed again. On the contrary, if the compressor is in an operation state, it means that refrigerant leakage has occurred. Accordingly, the controller determines that refrigerant leakage has occurred, and stops the compressor being operated (S06).

Figure 5:
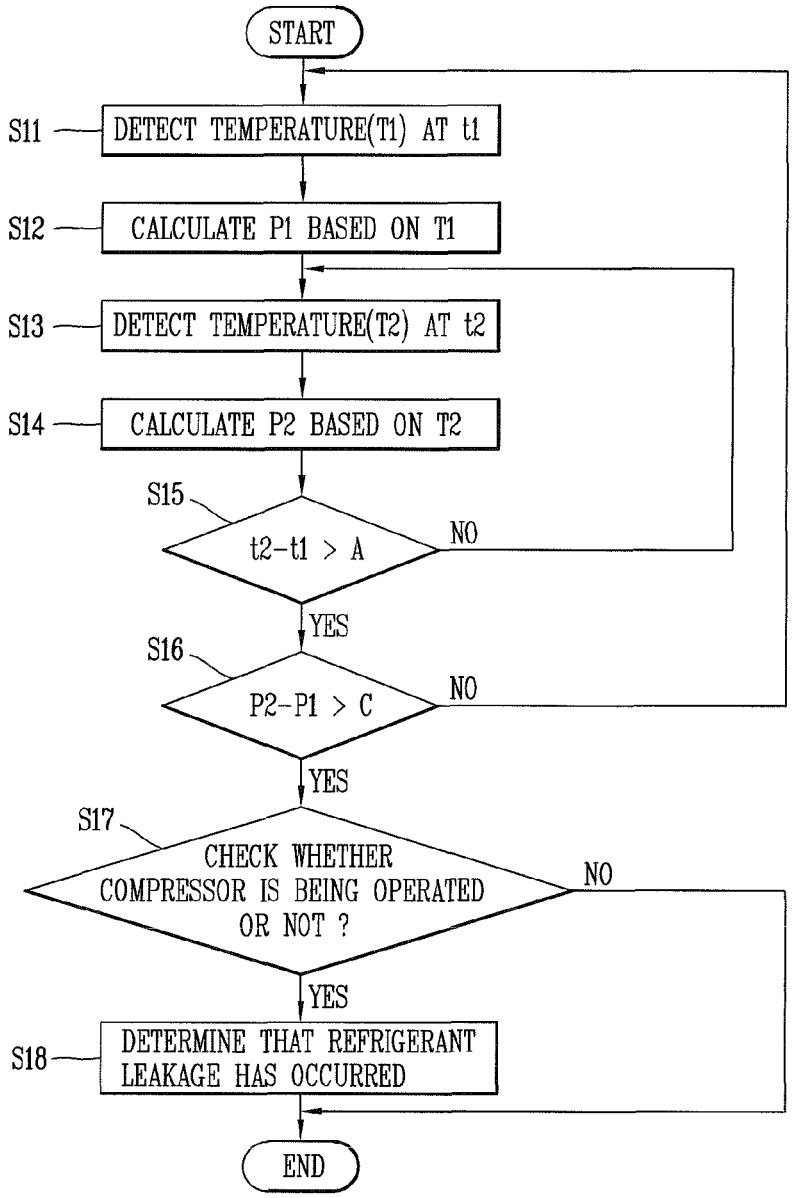
FIG. 5 is a flowchart illustrating other processes of detecting whether a refrigerant has leaked or not.

The method is not limited to the aforementioned embodiment, but may include a process of converting a measured temperature into a pressure. This process is illustrated in FIG. 5. Referring to FIG. 5, a temperature (T1) is detected at any time point (t1) (S11). Here, the temperature is detected from the surface of the condenser. Once the temperature (T1) is obtained, a pressure (P1) corresponding to the T1 is calculated by referring to an equation of state based on the T1, or a temperature-pressure conversion table predetermined through experiments (S12). Then, a temperature (T2) is detected at a time point (t2) after a predetermined time has lapsed (S13), and P2 is calculated based on the T2 (S14). Once the temperature detections and the pressure calculations have been executed twice, a time interval (t2−t1) is obtained. Then, it is determined whether the time interval (t2−t1) exceeds a predetermined value (A) (S15). If the time interval is less than the predetermined value (A), S13 is executed again. On the contrary, if the time interval is more than the predetermined value (A), S15 is executed.

In S16, it is determined whether the calculated pressure difference (P2−P1) exceeds a predetermined value (C). If the pressure difference is less than the predetermined value (C), it means that no refrigerant leakage has occurred. Accordingly, S11 is executed again. If the pressure difference is more than the predetermined value (C), it means a high possibility of refrigerant leakage. In a case that the compressor has been stopped, the pressure difference may exceed the predetermined value (C) due to a non-operation of the compressor even if no refrigerant leakage has occurred. Accordingly, whether the compressor is being operated or not is checked in S17. If the compressor is in a non-operating state, S11 is executed again. On the contrary, if the compressor is in an operation state, it means that refrigerant leakage has occurred. Accordingly, the controller determines that refrigerant leakage has occurred, and stops the compressor being operated (S18).

The invention claimed is:

1. A method for diagnosing a clothes treating apparatus comprising:

a drum configured to accommodate therein an object to be dried;

an air suction means configured to form a flow path of air introduced into the drum;

an air exhaustion means configured to form a flow path of air exhausted from the drum;

a condenser disposed to heat air sucked into the drum through the air suction means;

an evaporator disposed to cool air exhausted from the drum through the air exhaustion means; and a compressor and an expander configured to constitute a heat pump together with the condenser and the evaporator, the method comprising:

a temperature detection step of detecting a temperature change of air passing through the condenser or the air suction means; and a determination step of determining that refrigerant leakage has occurred when a temperature decrease amount measured in the temperature detection step is more than a predetermined level.

2. The method of claim 1, further comprising a check step of checking an operation state of the compressor, wherein the determination step is executed only when the compressor is operated.

3. The method of claim 1, wherein in the temperature detection step, a temperature is measured from a surface of the condenser.

4. The method of claim 3, wherein a temperature measurement point is positioned outside the air suction flow path.

5. A method for diagnosing a clothes treating apparatus comprising:

a drum configured to accommodate therein an object to be dried;

an air suction means configured to form a flow path of air introduced into the drum;

an air exhaustion means configured to form a flow path of air exhausted from the drum;

a condenser disposed to heat air sucked into the drum through the air suction means;

an evaporator disposed to cool air exhausted from the drum through the air exhaustion means; and a compressor and an expander configured to constitute a heat pump together with the condenser and the evaporator, the method comprising:

a temperature detection step of detecting a temperature of a surface of the condenser;

a pressure calculation step of calculating a pressure of a refrigerant inside the heat pump based on the detected temperature; and a determination step of determining that refrigerant leakage has occurred when a pressure lowering amount of the refrigerant is more than a predetermined level.

6. The method of claim 5, wherein in the temperature detection step, a temperature measurement point is positioned outside the air suction flow path.

7. The method of claim 1, further comprising a check step of checking an operation state of the compressor, wherein the determination step is executed only when the compressor is operated.

8. A clothes treating apparatus, comprising:

a drum configured to accommodate therein an object to be dried;

an air suction means configured to form a flow path of air introduced into the drum;

an air exhaustion means configured to form a flow path of air exhausted from the drum;

a condenser disposed to heat air sucked into the drum through the air suction means;

an evaporator disposed to cool air exhausted from the drum through the air exhaustion means;

a compressor and an expander configured to constitute a heat pump together with the condenser and the evaporator;

a temperature detecting means configured to measure a temperature of the refrigerant; and a controller configured to determine whether refrigerant leakage has occurred or not based on a change of temperatures measured by the temperature detecting means.

9. The clothes treating apparatus of claim 8, wherein the temperature detecting means is attached to a surface of the condenser.

10. The clothes treating apparatus of claim 9, wherein the condenser comprises:

a heat transfer portion contacting air moving after being introduced into the air suction means; and a non-contact portion not contacting the air, wherein the temperature detecting means is attached to the non-contact portion.

11. A method for diagnosing a clothes treating apparatus comprising:

a drum configured to accommodate therein an object to be dried;

an air suction means configured to form a flow path of air introduced into the drum;

an air exhaustion means configured to form a flow path of air exhausted from the drum;

a condenser disposed to heat air sucked into the drum through the air suction means;

an evaporator disposed to cool air exhausted from the drum through the air exhaustion means;

a compressor and an expander configured to constitute a heat pump together with the condenser and the evaporator; and a heater configured to additionally heat air having passed through the condenser, the method comprising:

a temperature detection step of detecting a temperature change of air near the heater; and a determination step of determining that refrigerant leakage has occurred when a temperature decrease amount measured in the temperature detection step is more than a predetermined level.

12. The method of claim 11, further comprising a check step of checking an operation state of the compressor, wherein the determination step is executed only when the compressor is operated.

13. The method of claim 11, wherein in the temperature detection step, a temperature is measured on a surface of the air suction means facing the heater.

14. The method of claim 11, wherein if it is determined that refrigerant leakage has occurred, executing a drying operation by stopping the compressor and by operating only the heater.

15. The method of claim 14, further comprising informing a user of refrigerant leakage in a visual or audible manner.

16. A clothes treating apparatus, comprising:

a drum configured to accommodate therein an object to be dried;

an air suction means configured to form a flow path of air introduced into the drum;

an air exhaustion means configured to form a flow path of air exhausted from the drum;

a condenser disposed to heat air sucked into the drum through the air suction means;

an evaporator disposed to cool air exhausted from the drum through the air exhaustion means;

a compressor and an expander configured to constitute a heat pump together with the condenser and the evaporator;

a heater disposed in the air suction means, and configured to additionally heat air having passed through the condenser;

a temperature detecting means installed in the air suction means so as to face the heater; and a controller configured to determine whether refrigerant leakage has occurred or not based on a change of temperatures measured by the temperature detecting means.

17. The clothes treating apparatus of claim 16, wherein the air suction means comprises:

an air suction duct disposed on a bottom surface of the drum; and a backduct extending between the air suction duct and the drum, and disposed on a rear surface of the drum, wherein the temperature detecting means is installed on an inner wall surface of the backduct.

18. The clothes treating apparatus of claim 17, wherein the heater is disposed so as to be spacing from a surface of the backduct, and the temperature detecting means is disposed between the heater and the surface of the backduct.

* * * * *